US009316050B2

(12) United States Patent
Hsu et al.

(10) Patent No.: US 9,316,050 B2
(45) Date of Patent: Apr. 19, 2016

(54) CORDLESS CURTAIN ASSEMBLY

(71) Applicant: CHING FENG HOME FASHIONS CO., LTD., Fuxing Shiang, Changhua (TW)

(72) Inventors: Sheng-Ying Hsu, Fuxing Shiang (TW); Chun Jan Hsu, Fuxing Shiang (TW)

(73) Assignee: Ching Feng Home Fashions Co., Ltd., Fuxing Shiang (TW)

( * ) Notice: Subject to any disclaimer, the term of this patent is extended or adjusted under 35 U.S.C. 154(b) by 3 days.

(21) Appl. No.: 14/242,894

(22) Filed: Jun. 15, 2014

(65) Prior Publication Data

US 2015/0361716 A1 Dec. 17, 2015

(51) Int. Cl.
*E06B 9/32* (2006.01)
*E06B 9/322* (2006.01)

(52) U.S. Cl.
CPC ..... *E06B 9/32* (2013.01); *E06B 2009/3222* (2013.01)

(58) Field of Classification Search
USPC ..... 160/170, 168.1 R, 171, 173 R, 84.04, 160/84.05, 84.06
IPC ..... E06B 2009/3222,9/322; A47H 5/02
See application file for complete search history.

(56) References Cited

U.S. PATENT DOCUMENTS

| | | | | |
|---|---|---|---|---|
| 2,420,301 | A * | 5/1947 | Cusumano | 160/170 |
| 5,477,904 | A * | 12/1995 | Yang | 160/370.23 |
| 6,644,373 | B2 * | 11/2003 | Palmer | 160/168.1 R |
| 7,398,815 | B2 * | 7/2008 | Liang | 160/170 |
| 7,487,817 | B2 * | 2/2009 | Liang | 160/170 |
| 7,950,437 | B2 * | 5/2011 | Lin | 160/168.1 R |
| 7,984,745 | B2 * | 7/2011 | Wen et al. | 160/170 |
| 2006/0137831 | A1 * | 6/2006 | Lin | 160/84.04 |
| 2007/0119547 | A1 * | 5/2007 | Liang | 160/170 |
| 2007/0272364 | A1 * | 11/2007 | Liang | 160/84.05 |
| 2008/0289774 | A1 * | 11/2008 | Ying | 160/178.1 R |
| 2009/0173459 | A1 * | 7/2009 | Hsu et al. | 160/331 |

* cited by examiner

*Primary Examiner* — David Purol

(57) ABSTRACT

A cordless curtain assembly includes a head box, a control unit, a fixed part, a movable part, a spring, an operation cord and a bottom bar. The curtain body is connected between the head box and the bottom bar. The fixed part is fixed to the head box and the movable part is located between the fixed part and the spring which is connected between the movable part and a fixed member of the head box. The user pulls or pushes the bottom bar move the movable part and the spring so as to operate the operation cord to control the position of the curtain body.

7 Claims, 5 Drawing Sheets

CORDLESS CURTAIN ASSEMBLY

FIELD OF THE INVENTION

The present invention is a cordless curtain assembly, and more particularly, to a cordless curtain assembly with simple structure.

BACKGROUND OF THE INVENTION

A conventional curtain assembly generally comprises a curtain, a control unit and a control cord, wherein the control unit is located in the head box and connected with the control cord. When the user pulls the control cord, the curtain is moved upward or downward relative to the operation of the control unit and the control cord. However, the conventional curtain assembly involves a complicated structure. The control cord is connected to the control unit, if the user pulls the control cord too hard or releases the cord quickly, the curtain cannot be properly positioned at the desired position because the friction between the control cord and the parts that the control cord passes generate resistance. The user has to operate the control cord to adjust the position of the curtain several times.

Besides, the control cord is connected to the control unit, and the curtain is moved according to the operation of the control unit and the control cord, therefore, the control unit includes many parts and is complicate in structure. The connection between the control unit and the control cord is complicated and the manufacturing cost is high.

The present invention intends to provide a curtain assembly which does not need the control cord and the complicated structure. The control unit simply includes a fixed part, a movable part and a spring. The shortcomings mentioned are improved.

SUMMARY OF THE INVENTION

The present invention relates to a control unit for a curtain assembly, and comprises a spring having a first end and a second end, the second end of the spring is fixed to a head box of the curtain assembly. A fixed part is fixed to the head box and has a first passage defined therein. The fixed part has multiple first pillars located therein. A movable part is located in the head box and between the spring and the fixed part. The movable part has a second passage defined therein. Multiple second pillars are located in the second passage. Multiple rollers are connected to the movable part and movably in contact with the head box. A first fixed member is connected to the movable part, and the first end of the spring connected to the first fixed member. An operation cord has the first end fixed to the bottom bar of the curtain assembly, and the second end of the operation cord extends through the curtain body and the head box. The second end of the operation cord is wrapped to the first pillars via the first passage and the second pillars via the second passage in a back-and-forth form. The second end of the operation cord eventually extends through the head box and the curtain body, and is fixed to the bottom bar of the curtain assembly.

The present invention also provides a cordless curtain assembly and comprises a head box and a bottom bar, and a curtain body is connected between the head box and the bottom bar. The head box has a space defined therein and two holes are defined through the bottom of the head box. A spring has a first end and a second end, wherein the second end of the spring is fixed to the head box of the curtain assembly. A fixed part is fixed to the head box and has a first passage defined therein. The fixed part has multiple first pillars located therein. A movable part is located in the head box and between the spring and the fixed part. The movable part has a second passage defined therein. Multiple second pillars are located in the second passage. Multiple rollers are connected to the movable part and movably in contact with the head box. A fixed member is connected to the movable part and the first end of the spring is connected to fixed member. An operation cord has the first end fixed to the bottom bar of the curtain assembly, and the second end of the operation cord extends through the curtain body and one of the two holes through the bottom of the head box. The second end of the operation cord is wrapped to the first pillars via the first passage and the second pillars via the second passage in a back-and-forth form. The second end of the operation cord eventually extends through the other one of the two holes through the bottom of the head box and the curtain body, and is fixed to the bottom bar of the curtain assembly.

Preferably, the head box has two guide rails extending from two opposite insides in the space. The two guide rails each continuously extend longitudinally along the head box. The rollers of the movable part are movable along the guide rails.

Preferably, another fixed member is connected to the head box and the second end of the spring is connected to the fixed member of the head box.

Preferably, the curtain assembly is window blinds.

Preferably, the curtain assembly is a honeycomb curtain.

Preferably, the curtain assembly is a foldable shade.

The primary object of the present invention is to provide a control unit of a curtain assembly and the control unit includes less number of parts, and the structure of the control unit is simple.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
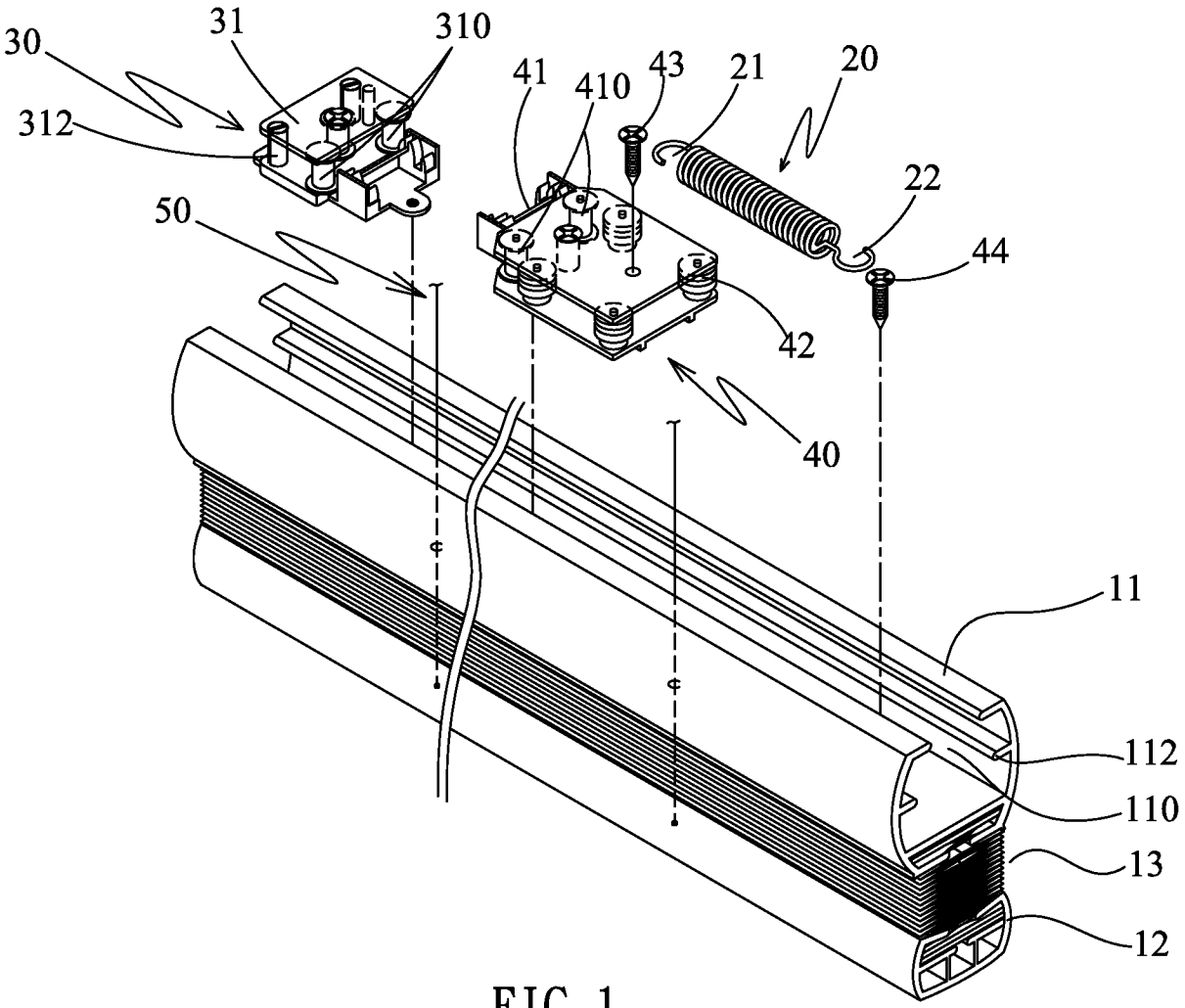
FIG. 1 is an exploded view to show the curtain assembly of the present invention.
Figure 2:
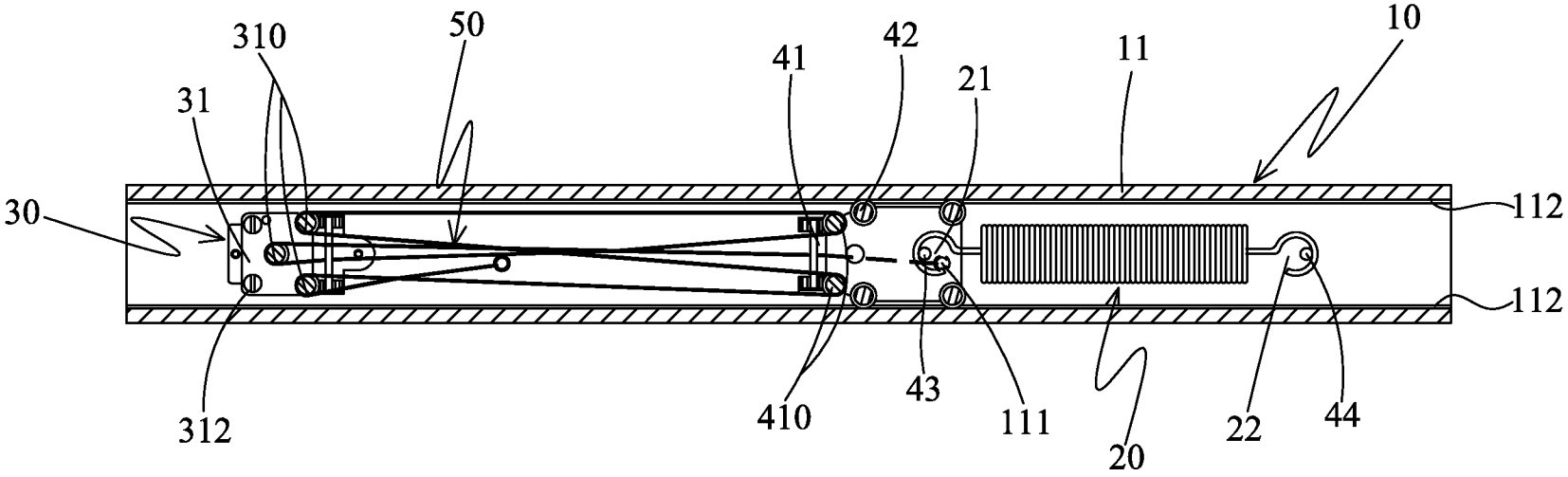
FIG. 2 is a top view to show the control unit in the head box of the curtain assembly of the present invention, wherein the spring is not extended.
Figure 3:
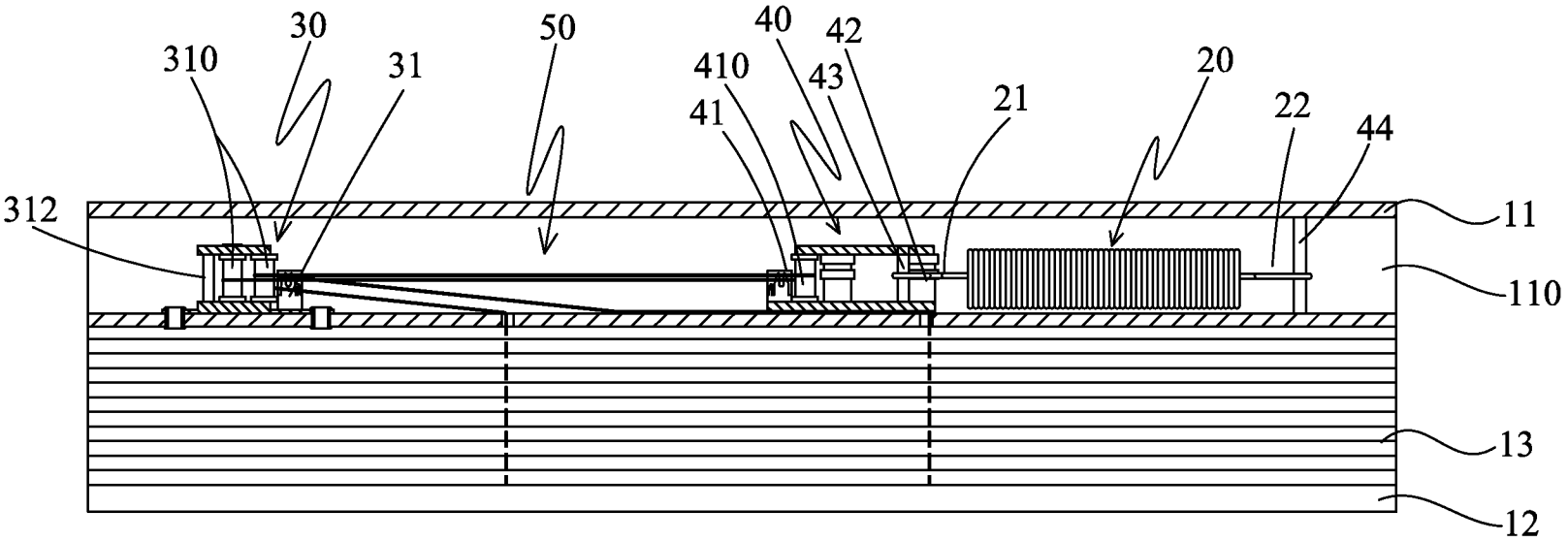
FIG. 3 is a side cross sectional view to show the curtain assembly wherein the curtain body is located at the higher position.

Referring to FIGS. 1 to 3, the curtain assembly 10 of the present invention comprises a head box 11, a bottom bar 12 and a curtain body 13 which is connected between the head box 11 and the bottom bar 12. The head box 11 has a space 110 defined therein and two holes 111 are defined through the bottom of the space 110. The control unit is located in the head box 11. The head box 11 has two guide rails 112 extending from two opposite insides in the space 110. The two guide rails 112 each continuously extend longitudinally along the two opposite insides of the head box 11. The curtain assembly is window blinds, a honeycomb curtain or a foldable shade.

A spring 20 is located in the space 110 and has a first end 21 and a second end 22, wherein the second end 22 of the spring 20 is fixed to the head box 11 of the curtain assembly 10.

A fixed part 30 is located in the space 110 and fixed to the head box 11. The fixed part 30 includes a top plate and a bottom plate. A first passage 31 is defined through the fixed part 30 and multiple first pillars 310 are located between the top plate and the bottom plate.

A movable part 40 is located in the space 110 of the head box and between the spring 20 and the fixed part 30. The movable part 40 includes a top plate and a bottom plate, a second passage 41 is defined between the top and bottom plates of the movable part 40. Multiple second pillars 410 are located in the second passage 41 and multiple rollers 42 are connected to the movable part 40 and movably in contact with the guide rails 112 of the head box 11. A first fixed member 43 is connected to the movable part 40 to combine the top and bottom plates thereof. The first end 21 of the spring 20 is connected to the first fixed member 43. A second fixed member 44 is connected to the head box 11 and the second end 22 of the spring 20 is fixed to the second fixed member 44 of the head box 11 of the curtain assembly 10.

An operation cord 50 has the first end thereof fixed to the bottom bar 12 of the curtain assembly, and the second end of the operation cord 50 extends through the curtain body 13 and one of the two holes 111 through the bottom of the head box 11 to enter into the space 110. The second end of the operation cord 50 is wrapped to the first pillars 310 via the first passage 31 and the second pillars 410 via the second passage 41 in a back-and-forth form. Eventually, the second end of the operation cord 50 extends through the other one of the two holes 111 through the bottom of the head box 11 and the curtain body 13, and then is fixed to the bottom bar 12 of the curtain assembly.

Figure 4:
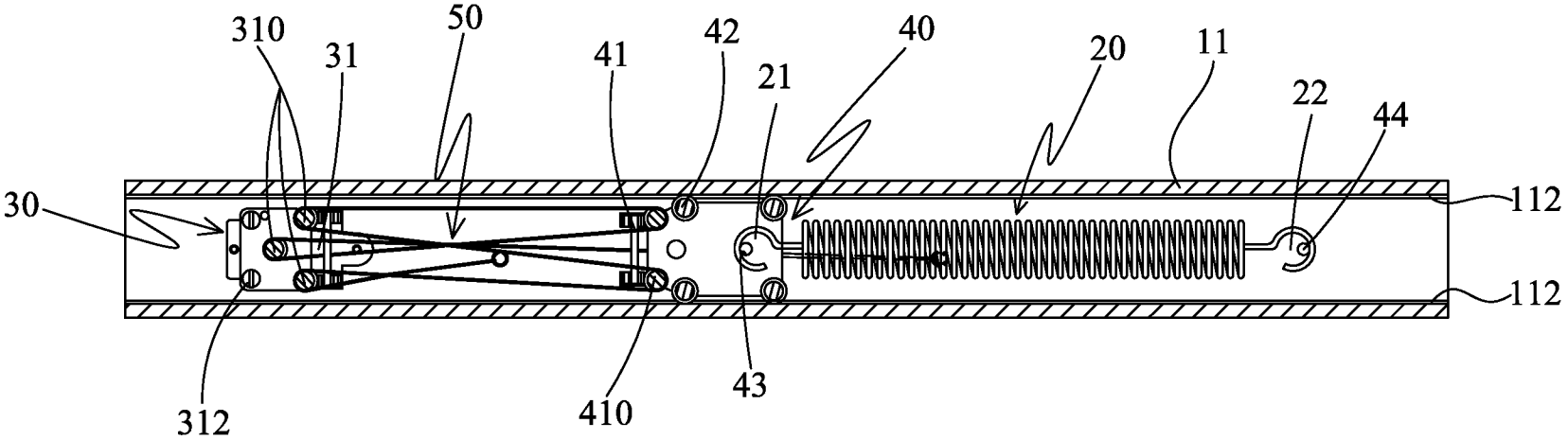
FIG. 4 is a top view to show that the spring of the control unit in the head box of the curtain assembly of the present invention is extended.
Figure 5:
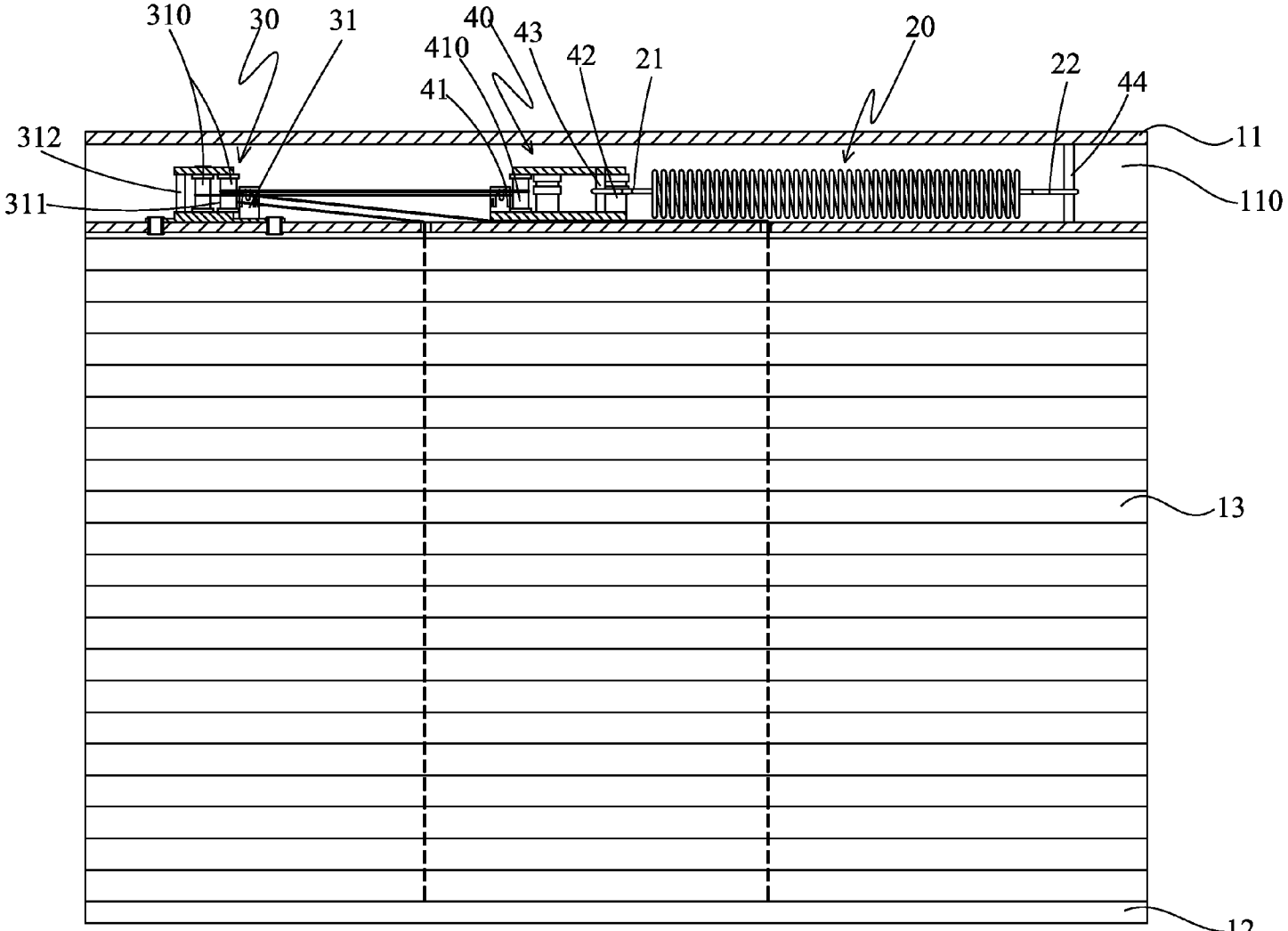
FIG. 5 is a side cross sectional view to show the curtain assembly wherein the curtain body is located at the lower position.

As shown in FIGS. 4 and 5, when the user pulls the bottom bar 12 downward, the operation cable 50 is pulled to move the movable part 40 toward the fixed part 30. The movement of the movable part 40 extends the spring 20 so that the operation cable 50 is released and the curtain body 13 is lowered.

When the user pushes the bottom bar 12 upward, the force stored in the spring 20 is released so that the spring 20 shrinks back to its initial status, and the movable part 40 is moved toward the spring 20, and the operation cable 50 lifts the curtain body 13.

The operation to the bottom bar 12 drives the operation cable 50 to move the movable part 40 and the spring 20 is expanded or deformed back to its initial status, such that the curtain body 13 is lowered or lifted. The operation is easy and the structure is simple. The manufacturing cost is therefore reduced.

There is no cord-winding control device needed as disclosed in U.S. Pat. No. 7,487,817, and the guide rails 13 are continuous rails without the positioning recesses as disclosed in U.S. Pat. No. 7,487,817. The number of parts of the present invention is less than that of U.S. Pat. No. 7,487,817, so that the manufacturing cost can be lowered, and the arrangement of the parts in the space 110 of the head box 11 is more flexible to meet users; practical needs.

While we have shown and described the embodiment in accordance with the present invention, it should be clear to those skilled in the art that further embodiments may be made without departing from the scope of the present invention.

What is claimed is:

1. A control unit for a curtain assembly, comprising:

a spring having a first end and a second end, the second end of the spring being fixed to a head box of the curtain assembly;

a fixed part fixed to the head box and having a first passage defined therein, the fixed part having multiple first pillars located therein;

a movable part located in the head box and between the spring and the fixed part, the movable part having a second passage defined therein, multiple second pillars located in the second passage, a number of the second pillars being different from a number of the first pillars, multiple rollers connected to the movable part and movably in contact with the head box, a first fixed member connected to the movable part, the first end of the spring connected to the first fixed member, and an operation cord having a first end fixed to a bottom bar of the curtain assembly, a second end of the operation cord continuous with the first end extending through the curtain body and the head box, the second end of the operation cord wrapped to the first pillars via the first passage and the second pillars via the second passage in a back-and-forth form, the second end of the operation cord extending through the head box and the curtain body and being fixed to the bottom bar of the curtain assembly.

2. A cordless curtain assembly comprising:

a head box and a bottom bar, a curtain body connected between the head box and the bottom bar, the head box having a space defined therein and two holes defined through a bottom of the head box;

a spring having a first end and a second end, the second end of the spring being fixed to the head box of the curtain assembly;

a fixed part fixed to the head box and having a first passage defined therein, the fixed part having multiple first pillars located therein;

a movable part located in the head box and between the spring and the fixed part, the movable part having a second passage defined therein, multiple second pillars located in the second passage, a number of the second pillars being different from a number of the first pillars, multiple rollers connected to the movable part and movably in contact with the head box, a fixed member connected to the movable part, the first end of the spring connected to fixed member, and an operation cord having a first end fixed to the bottom bar of the curtain assembly, a second end of the operation cord continuous with the first end extending through the curtain body and one of the two holes through the bottom of the head box, the second end of the operation cord wrapped to the first pillars via the first passage and the second pillars via the second passage in a back-and-forth form, the second end of the operation cord extending through the other one of the two holes through the bottom of the head box and the curtain body, and being fixed to the bottom bar of the curtain assembly.

3. The curtain assembly as claimed in claim 2, wherein the head box has two guide rails extending from two opposite insides in the space, the two guide rails each continuously extending longitudinally along the head box, the rollers of the movable part are movable along the guide rails.

4. The curtain assembly as claimed in claim 2, wherein another fixed member is connected to the head box and the second end of the spring is connected to the fixed member of the head box.

5. The curtain assembly as claimed in claim 2, wherein the curtain assembly is window blinds.

6. The curtain assembly as claimed in claim 2, wherein the curtain assembly is a honeycomb curtain.

7. The curtain assembly as claimed in claim 2, wherein the curtain assembly is a foldable shade.

* * * * *